US006081945A

United States Patent [19]

Keene et al.

[11] Patent Number: 6,081,945

[45] Date of Patent: Jul. 4, 2000

[54] ROTARY HYDROTHERAPY NOZZLE

[76] Inventors: Linda Keene; Michael Guerini, both of 5820 Patterson Rd., Bozeman, Mont. 59718

[21] Appl. No.: 09/191,551

[22] Filed: Nov. 13, 1998

[51] Int. Cl.[7] ..... A47K 3/22

[52] U.S. Cl. ..... 4/615; 239/383

[58] Field of Search ..... 4/615, 541.1, 541.2, 4/541.3, 541.4, 541.5, 541.6, 492; 239/237, 240, 263, 380, 381, 382, 383, 463, 466, 581.1, 569, 530, 583

[56] References Cited

U.S. PATENT DOCUMENTS

| | | | |
|---|---|---|---|
| 2,624,559 | 6/1953 | Hyde | 239/383 |
| 3,568,716 | 3/1971 | Heitzman | 137/624.14 |
| 3,637,143 | 1/1972 | Shames et al. | 239/530 |
| 4,010,899 | 3/1977 | Heitzman | 239/101 |
| 4,098,461 | 7/1978 | Weller | 239/381 |
| 4,254,914 | 3/1981 | Shames et al. | 239/283 |
| 4,346,844 | 8/1982 | Harmony | 239/383 |
| 4,350,158 | 9/1982 | Hudson | 128/224 |
| 4,432,355 | 2/1984 | Delluc | 128/56 |
| 4,552,132 | 11/1985 | Ruscigno | 128/38 |
| 4,588,130 | 5/1986 | Trenary et al. | 239/381 |
| 4,630,599 | 12/1986 | Perovick et al. | 128/66 |
| 4,674,687 | 6/1987 | Snith et al. | 239/447 |
| 4,901,379 | 2/1990 | Chalberg et al. | 4/543 |
| 4,926,510 | 5/1990 | Watkins | 4/542 |
| 4,958,629 | 9/1990 | Peace et al. | 128/66 |
| 5,090,624 | 2/1992 | Rogers | 239/381 |
| 5,226,601 | 7/1993 | Hinojosa et al. | 239/423 |
| 5,230,106 | 7/1993 | Henkin et al. | 4/541.1 |
| 5,269,029 | 12/1993 | Spears et al. | 4/541.6 |
| 5,271,561 | 12/1993 | Tobia et al. | 239/289 |
| 5,316,216 | 5/1994 | Cammack et al. | 239/71 |
| 5,333,791 | 8/1994 | Carlo | 239/428.5 |
| 5,353,447 | 10/1994 | Gravatt | 4/541.6 |
| 5,477,567 | 12/1995 | Del Fresno | 4/559 |
| 5,526,540 | 6/1996 | Johnson | 4/541.6 |
| 5,634,890 | 6/1997 | Morris | 601/166 |
| 5,657,496 | 8/1997 | Corb et al. | 4/541.6 |

OTHER PUBLICATIONS

Various US PTO Official Gazette Pages for: 4,099,522; 4,019,502; 4,759,544; D259,953; 3,534,730; D318,900.

*Primary Examiner*—Henry J. Recla
*Assistant Examiner*—Huyen Le
*Attorney, Agent, or Firm*—Dennis Beech

[57] ABSTRACT

The rotary hydrotherapy nozzle is a cylindrical tube forming a nozzle with a hand grip sleeve on a first stage tube and having an on-off valve. The tube has a rotary element contained in a discharge end which has multiple discharge ports. The tube intake end is threaded to receive the first stage tube or a water hose. The rotary element is a cylindrical body shaped to rotate in the discharge end. The rotary element has an outlet end with an outlet port shaped to alternately inhibit and allow water flow through the discharge ports as rotation occurs. The rotary element inlet end has a water vane which causes rotation due to the water flow impact thereon from the water inlet disk which has skewed ducts to direct water flow against the blades of the water vane.

5 Claims, 2 Drawing Sheets

ROTARY HYDROTHERAPY NOZZLE

BACKGROUND OF THE INVENTION

1. Field of the Invention

This invention relates to devices used to apply hydrotherapy with a pulsating pressure water flow intending to be a massaging application for animals and humans. The new device has a rotating element in a water conduit which may be attached to the end of a water hose or other suitable source to provide a hand held portable device. The pulsating spray may also be used for watering plants.

2. Description of Related Art

There are currently in use various hydromassage devices which are used with spas and showers. By the nature of their design they are mechanically complicated internally to provide a variety of pulsating water flow conditions or are designed for use when immersed in water such as in a spa. The adjustable shower head for use in human showers and baths may be attached to the water outlet pipe or may have an intermediate flexible conduit. The hydromassage head typically has a rotating adjustment element to provide direct and various types of pulsating water flow. The typical spa hydromassage device has a rotating element of one or more outlet conduits which cause the water to sweep around in a circular motion as the outlet conduit rotates around a central axis. The devices also typically introduce air into the water stream prior to discharge.

The present invention has a rotating element in a water conduit with an end cap having outlet ports proportionally spaced to allow water to escape from a selected number of outlet ports at any instant of time. Depending on the rotating element discharge port size selection, the escaping water flow is repeatedly inhibited and allowed from a subset of the outlet ports creating a pulsating water flow for hydrotherapy. The rotary hydrotherapy device may be threaded onto a water hose.

SUMMARY OF THE INVENTION

One object of the present invention is to provide a pulsating water discharge for application to animals and humans for use in hydrotherapy and for watering plants. Another object is to use an integral rotating element in a water conduit in cooperation with outlet ports of the water conduit to supply a pulsating water discharge. A further object is operation in a portable manner for ease of attachment and use with a water hose.

In accordance with the description presented herein, other objectives of this invention will become apparent when the description and drawings are reviewed.

DESCRIPTION OF THE PREFERRED EMBODIMENT

The rotary hydrotherapy nozzle has a cylindrical shaped tube with the discharge end capped and having a plurality of outlet holes therein. The intake end is open and threaded internally for attachment to for example a water hose. Inserted in the tube is a rotary element with an outlet end cap having an outlet port and a water vane element inserted in the input end. A water inlet disk with skewed ducts and a gasket retains the rotary element in the tube.

Figure 1:
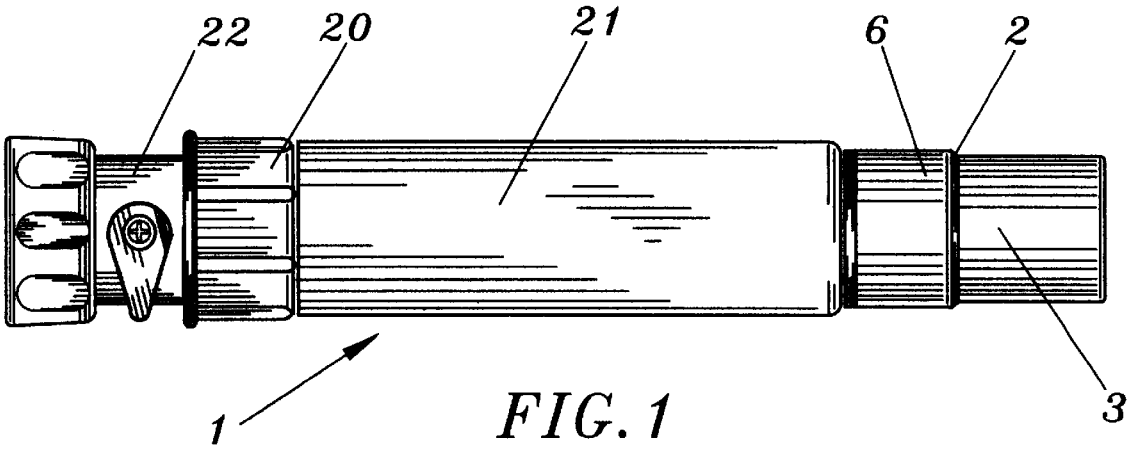
FIG. 1 illustrates a side view of the invention.
Figure 2:
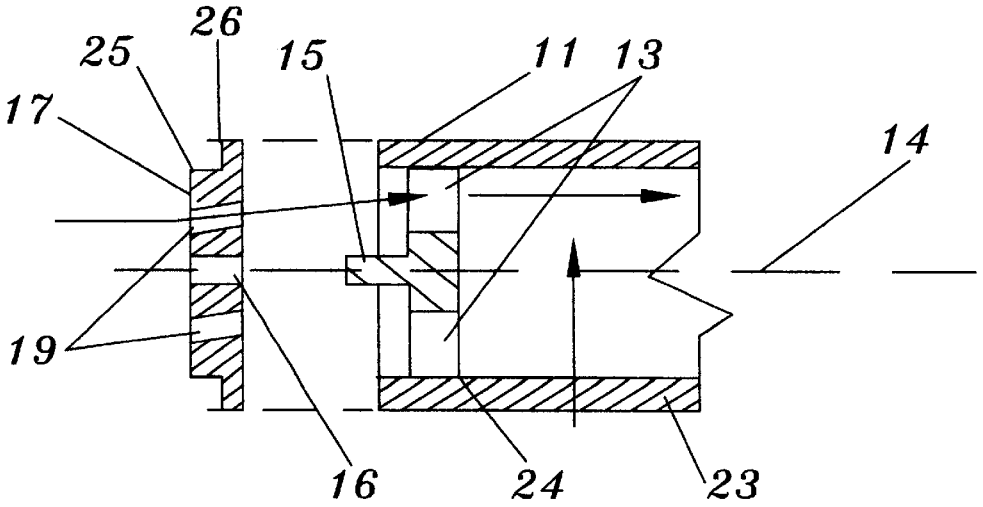
FIG. 2 illustrates a partial cross-section view of the rotating element and water inlet disk.
Figure 3:
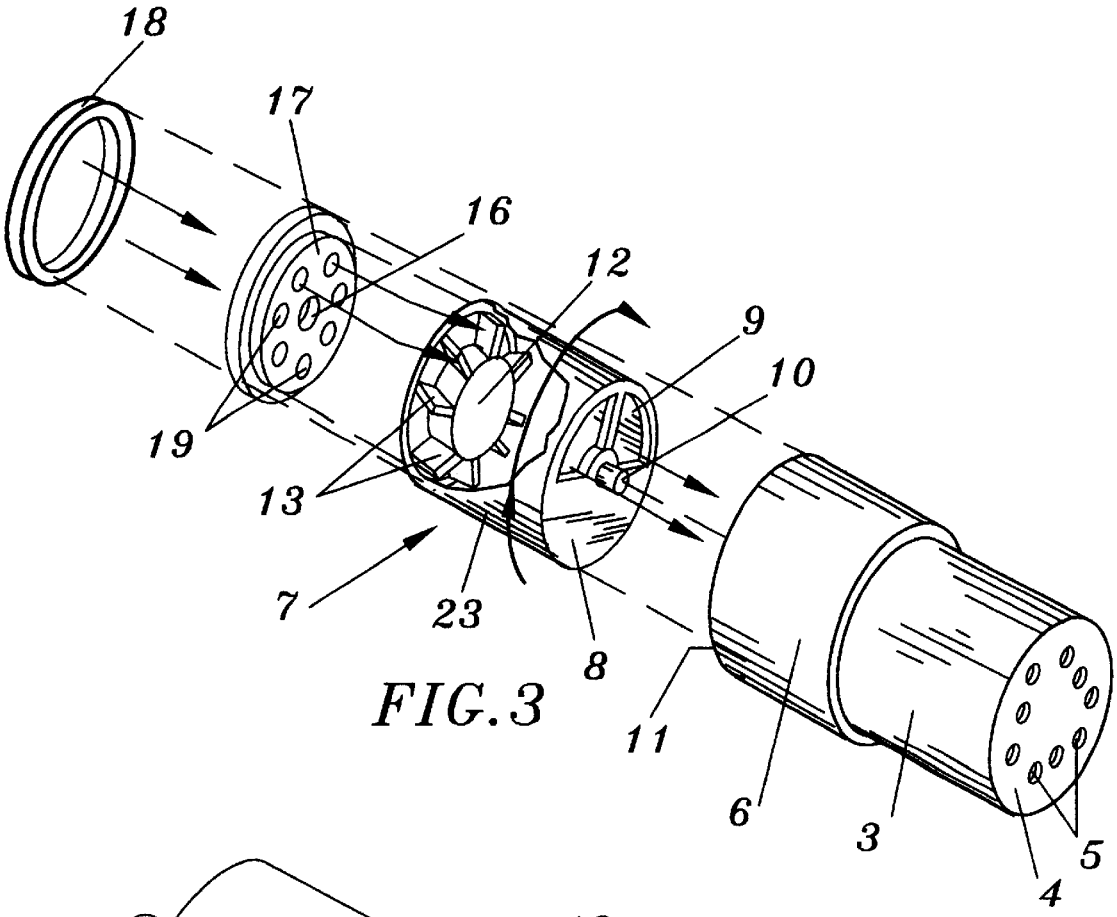
FIG. 3 illustrates a perspective exploded view of the elements of the nozzle.
Figure 4:
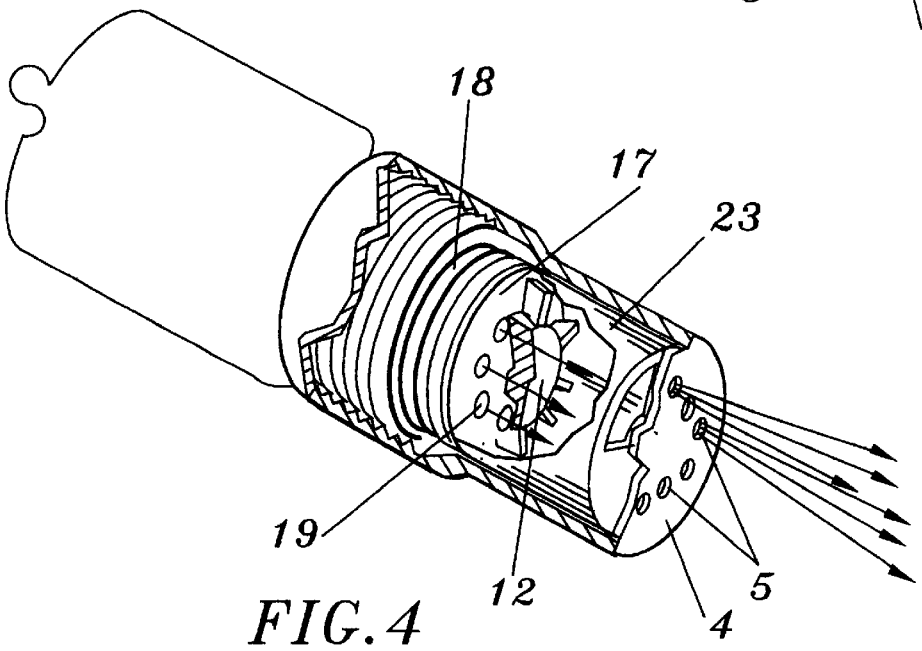
FIG. 4 illustrates a perspective partial cutaway view of the assembled nozzle.

Referring to FIGS. 1 through 4, a cylindrical shaped tube (2) is capped at a discharge end (3) by an end cap (4) having a plurality of discharge ports (5) defined therein. The intake end (6) is open and threaded internally for attachment to a water hose connector (not shown). The tube (2) as shown has a slightly larger diameter cross section at the intake end (6) as compared to the discharge end (3) to allow for threading or otherwise providing an attachment means for a water source.

A rotating element (7) is inserted in the tube (2) and has a cross section outside diameter to allow the rotating element (7) to rotate in the discharge end (3). The outlet end (8) has two outlet ports (9) formed therein which for the preferred embodiment is approximately one half the area of the outlet end (8). The outlet end (8) also has a pedestal (10) to space the outlet end (8) away from the end cap (4) of the tube (2).

The rotating element (7) has a body (23) with an inlet end (11) which is open and opposite the outlet end (8). A water vane (12) having a plurality of blades (13) is pressed into the inlet end (11) and may be held in place by a friction fit, epoxy or other suitable fixing means. A step or shelf may be provided around the inside wall of the body (23) at location (24) to seat the blades (13). The blades (13)are skewed relative to the longitudinal center axis (14) of the tube (2). The water vane (12) has a center pedestal (15) oriented toward the tube (2) intake end (6) when inserted in the rotating element (7).

The center pedestal (15) is of a length to engage an aperture (16) in a water inlet disk (17). The water inlet disk (17) is seated in the tube (2) against the rotating element (7) and has a washer (18) or gasket for sealing against a water hose connector or the first stage tube (20). The water inlet disk (17) is illustrated with a smaller diameter tube end (25) as compared to the rotating element end (26). This provides a position for mounting the washer (18). However, the water inlet disk (17) may also be used without such variable diameter elements in which instance the washer (18) rests against the water inlet disk (17) and is held against it by the water hose connector similar to common attachments for water hose. A plurality of ducts (19) are formed in the water inlet disk (17) and are skewed relative to the center line (14).

When a stream of water is forced under pressure into the intake end (6) the stream of water longitudinal direction is skewed by the ducts (19) to impact blades (13) to impart a rotational motion about the longitudinal axis of the rotating element (7). This rotation causes the outlet port (9) to alternately open and close various discharge ports (5) creating a pulsating water flow discharge from the rotary hydrotherapy nozzle (1).

A first stage tube (20) with a hand grip sleeve (21) may be attached to the intake end (6) for better gripping by the user when soap, detergents and the like are being used with the rotary hydrotherapy massage (1). In addition a valve (22) element may be attached to provide an on-off valve for better utility for example when the rotary hydrotherapy nozzle (1) is used at the end of a long water hose.

While the invention has been particularly shown and described with respect to the illustrated and preferred embodiments thereof, it will be understood by those skilled in the art that the foregoing and other changes in form and details may be made therein without departing from the spirit and scope of the invention.

We claim:

1. A device for a water source outlet pressure variation comprising:

a tube of cylindrical shape with a discharge end having an end cap with a plurality of discharge ports defined therein;

an intake end of the tube being open and having a means for attachment to a water source;

a rotating element inserted in the discharge end and the rotating element comprising:

a) a body with an outlet end having an outlet port defined therein and a pedestal;

b) an inlet end opposite the outlet end which is open; and c) a water vane having a plurality of blades and a center pedestal being inserted in and retained in the inlet end with the center pedestal oriented along a center line toward the intake end; and a water inlet disk inserted in the discharge end having an aperture defined therein into which the center pedestal slidably fits, the water inlet disk having a plurality of ducts skewed relative to the center line formed around the aperture and the water inlet disk in the intake end by the attachable water source.

2. The device as in claim 1 wherein there is a circumferential step around the inside wall of the body on which to seat the blades.

3. The device as in claim 1 wherein the water inlet disk having a smaller diameter tube end relative to a rotating element end.

4. A device for a water source outlet pressure variation comprising:

a tube of cylindrical shape with a discharge end having an end cap with a plurality of discharge ports defined therein;

an intake end of the tube being open and having a means for attachment to a water source;

a rotating element inserted in the discharge end and the rotating element comprising:

a) a body with an outlet end having an outlet port defined therein and a pedestal;

b) an inlet end opposite the outlet end which is open; and c) a water vane having a plurality of blades and a center pedestal being inserted in and retained in the inlet end wherein there is a circumferential step around the inside wall of the body on which to seat the blades and with the center pedestal oriented along a center line toward the intake end; and a water inlet disk inserted in the discharge end having an aperture defined therein into which the center pedestal slidably fits and the water inlet disk having a plurality of ducts skewed relative to the center line formed around the aperture.

5. A device for a water source outlet pressure variation comprising:

a tube of cylindrical shape with a discharge end having an end cap with a plurality of discharge ports defined therein;

an intake end of the tube being open and having a means for attachment to a water source;

a rotating element inserted in the discharge end and the rotating element comprising:

a) a body with an outlet end having an outlet port defined therein and a pedestal;

b) an inlet end opposite the outlet end which is open; and c) a water vane having a plurality of blades which are skewed relative to the center line and a center pedestal being inserted in and retained in the inlet end with the center pedestal oriented along a center line toward the intake end; and a water inlet disk inserted in the discharge end having an aperture defined therein into which the center pedestal slidably fits and the water inlet disk having a plurality of ducts skewed relative to the center line formed around the aperture.

* * * * *